US007705790B2

(12) United States Patent
Booth et al.

(10) Patent No.: US 7,705,790 B2
(45) Date of Patent: Apr. 27, 2010

(54) ANTENNA MOUNTING METHOD

(75) Inventors: Robert Booth, San Marcos, CA (US); Ohad Shavit, Tiberias (IL)

(73) Assignee: Galtronics Ltd., Tiberias (IL)

( * ) Notice: Subject to any disclaimer, the term of this patent is extended or adjusted under 35 U.S.C. 154(b) by 202 days.

(21) Appl. No.: 12/128,814

(22) Filed: May 29, 2008

(65) Prior Publication Data

US 2008/0309564 A1 Dec. 18, 2008

Related U.S. Application Data

(60) Provisional application No. 60/932,204, filed on May 29, 2007.

(51) Int. Cl.
*H01Q 1/24* (2006.01)

(52) U.S. Cl. ..... 343/702; 343/878; 343/892

(58) Field of Classification Search ..... 343/702, 343/700 MS, 878, 892
See application file for complete search history.

(56) References Cited

U.S. PATENT DOCUMENTS

| | | | | |
|---|---|---|---|---|
| 6,903,695 | B2 * | 6/2005 | Sjoblom et al. | 343/702 |
| 6,972,721 | B2 * | 12/2005 | Park | 343/702 |
| 7,023,387 | B2 | 4/2006 | Wen et al. | |
| 7,151,493 | B2 | 12/2006 | Wen et al. | |
| 7,429,954 | B2 * | 9/2008 | Doczy et al. | 343/702 |
| 7,474,268 | B2 * | 1/2009 | Cheng et al. | 343/702 |
| 7,538,731 | B2 * | 5/2009 | Wong et al. | 343/702 |
| 2003/0090469 | A1 | 5/2003 | Tao | |
| 2003/0124985 | A1 | 7/2003 | Shin et al. | |
| 2007/0115187 | A1 * | 5/2007 | Zhang et al. | 343/702 |
| 2008/0278401 | A1 * | 11/2008 | Yu | 343/878 |

FOREIGN PATENT DOCUMENTS

| | | |
|---|---|---|
| EP | 1432069 | 6/2004 |
| EP | 1705750 | 9/2006 |
| WO | WO-9854785 | 12/1998 |

OTHER PUBLICATIONS

U.S. Appl. No. 60/932,204, filed May 29, 2007.

* cited by examiner

*Primary Examiner*—Hoang V Nguyen
(74) *Attorney, Agent, or Firm*—Darby & Darby P.C.

(57) ABSTRACT

A method of mounting an antenna assembly into computer apparatus including forming a mounting bracket on an interior surface of a housing of the computer apparatus, the mounting bracket including at least two upstanding surfaces defining a gap therebetween, and inserting a first portion of the antenna assembly into engagement with the mounting bracket and adhering a second portion of the antenna assembly to the interior surface.

20 Claims, 5 Drawing Sheets

ANTENNA MOUNTING METHOD

REFERENCE TO RELATED APPLICATIONS

Reference is hereby made to U.S. Provisional Patent Application 60/932,204, filed May 29, 2007 and entitled H-GUIDE FIXATION METHOD FOR ANTENNAS, the disclosure of which is hereby incorporated by reference and priority thereof is hereby claimed under 37 CFR 1.78(a) (4) and (5)(i).

FIELD OF THE INVENTION

The present invention relates to fixation of antennas, such as antennas for WiFi, WWAN and WiMAX applications, in computer apparatus, such as laptop computers.

BACKGROUND OF THE INVENTION

The following publications are believed to represent the current state of the art:

U.S. Pat. Nos. 7,023,387 and 7,151,493.

SUMMARY OF THE INVENTION

The present invention seeks to provide improved apparatus and methodology for fixation of antennas in computer apparatus, particularly laptop computers.

There is thus provided in accordance with a preferred embodiment of the present invention a method of mounting an antenna assembly into computer apparatus including forming a mounting bracket on an interior surface of a housing of the computer apparatus, the mounting bracket including at least two upstanding surfaces defining a gap therebetween, and inserting a first portion of the antenna assembly into engagement with the mounting bracket and adhering a second portion of the antenna assembly to the interior surface.

There is also provided in accordance with another preferred embodiment of the present invention an arrangement for mounting an antenna assembly into computer apparatus including a mounting bracket formed on an interior surface of a housing of the computer apparatus, the mounting bracket including at least two upstanding surfaces defining a gap therebetween and an antenna assembly including a first portion mounted into engagement with the mounting bracket and a second portion adhered to the interior surface.

There is further provided in accordance with yet another preferred embodiment of the present invention a portable computer including computer processing, data input and display functionality enclosed in a housing and an arrangement for mounting an antenna assembly into a portion of the housing, the arrangement including a mounting bracket formed on an interior surface of a housing of the computer apparatus, the mounting bracket including at least two upstanding surfaces defining a gap therebetween and an antenna assembly including a first portion mounted into engagement with the mounting bracket and a second portion adhered to the interior surface.

Preferably, the mounting bracket includes first and second generally planar mutually spaced parallel upstanding portions and a third upstanding portion extending generally perpendicularly to the first and second generally planar portions from the first upstanding portion towards the second upstanding portion and defining a gap with respect to the second upstanding portion. Additionally or alternatively, the second portion of the antenna assembly is adhered to the interior surface by means of a conductive adhesive and the interior surface defines a ground plane.

In accordance with a preferred embodiment of the present invention, the second portion of the antenna assembly is positioned with respect to the interior surface by means of a protrusion formed on the interior surface which engages an aperture formed in the second portion of the antenna assembly.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
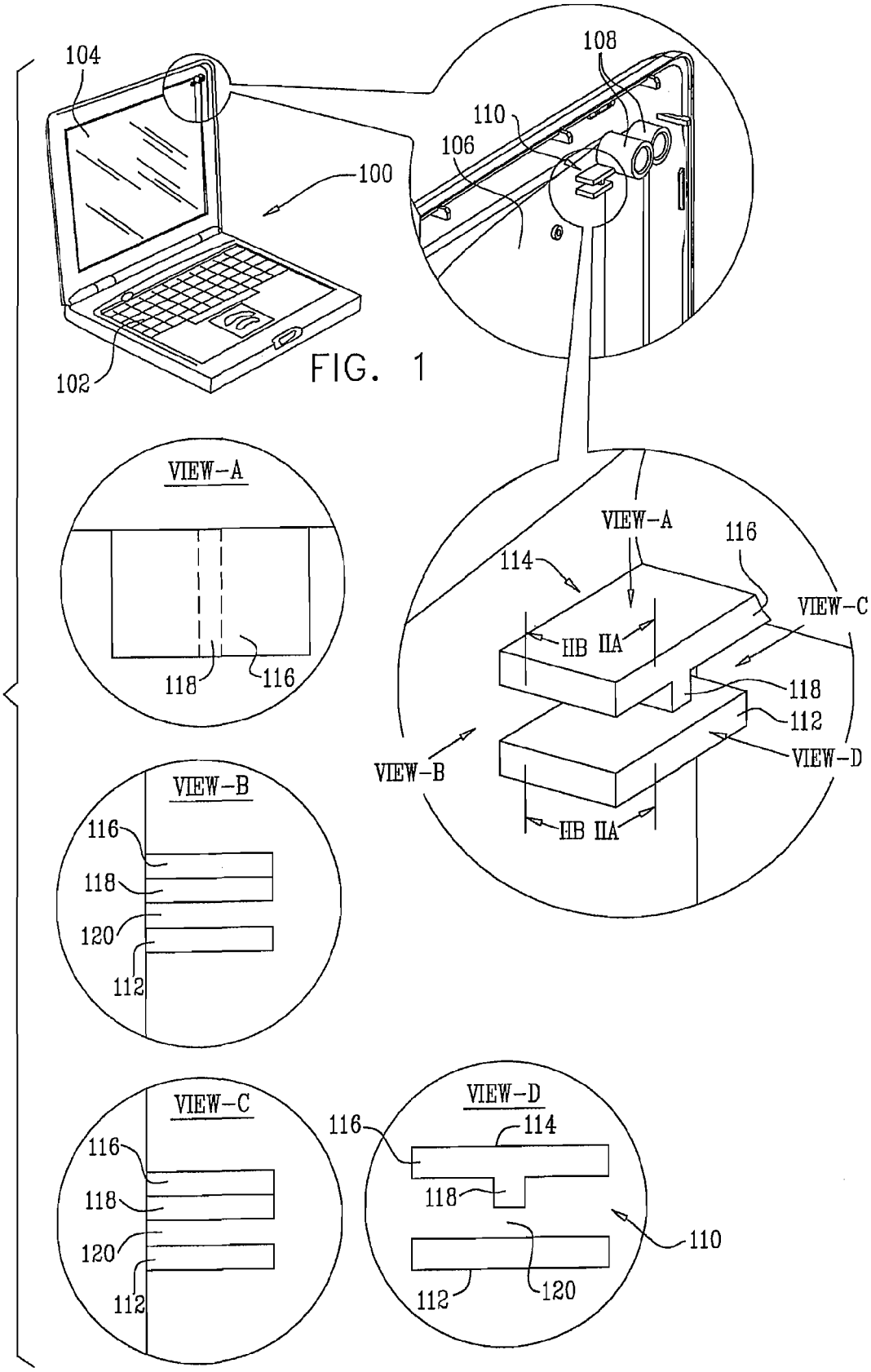
FIG. 1 is a simplified illustration of a portion of a disassembled laptop computer having an H-guide bracket for mounting of an antenna assembly in accordance with a preferred embodiment of the present invention.
Figure 2A:
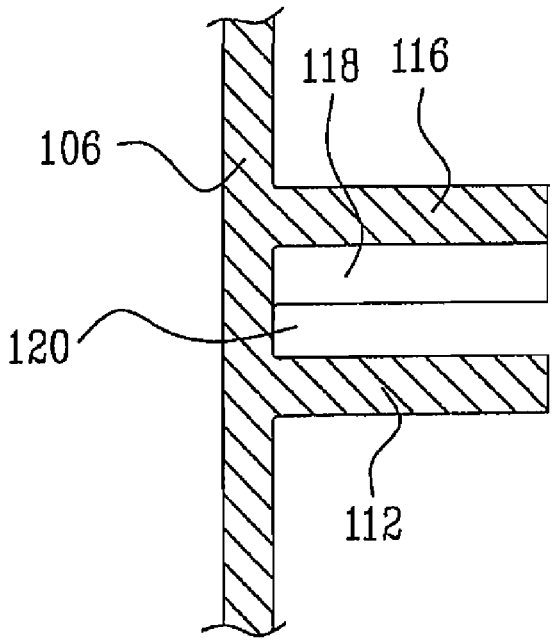
FIGS. 2A & 2B are simplified sectional illustrations of the H-guide bracket of FIG. 1.
Figure 2B:
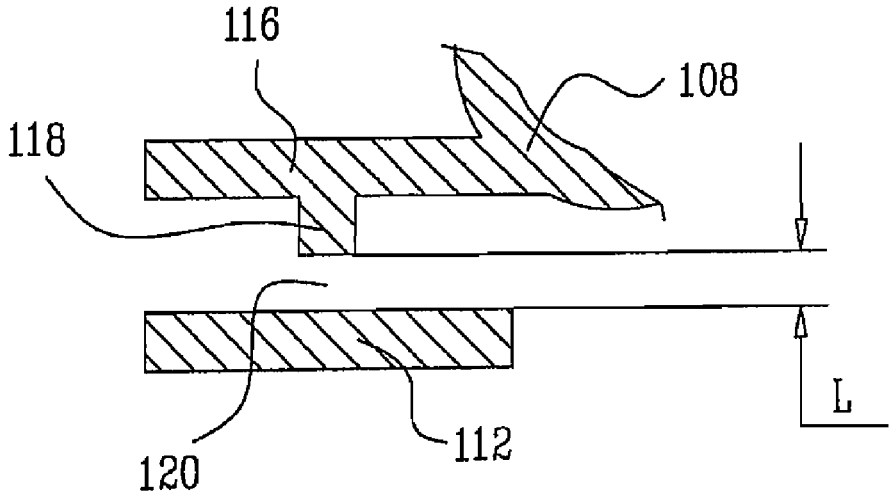

Reference is now made to FIG. 1, which is a simplified illustration of a portion of a disassembled laptop computer having an H-guide bracket for mounting of an antenna assembly in accordance with a preferred embodiment of the present invention, and to FIGS. 2A & 2B, which are simplified sectional illustrations of the H-guide bracket of FIG. 1.

As seen in FIGS. 1, 2A and 2B, a typical laptop computer has a two part housing 100, including a keyboard housing portion 102 and a display housing portion 104. Display housing portion 104 preferably includes, inter alia, a generally planar back interior surface 106, which is preferably conductive and defines a ground plane, and a pair of generally cylindrical attachment portions 108.

In accordance with a preferred embodiment of the present invention, there is integrally formed at the interior of the display housing portion 104 an H-guide bracket 110 including an upstanding planar portion 112 and an upstanding T-shaped portion 114, including an upstanding planar portion 116, extending generally parallel to and spaced from upstanding planar portion 112 and a perpendicularly extending portion 118, extending perpendicularly from portion 116, preferably at the middle thereof, towards upstanding planar portion 112 and defining a gap 120 between the end of portion 118 and upstanding planar portion 112. The thickness of gap 120, designated by L in FIG. 2B, is preferably 0.6 mm.

Figure 3:
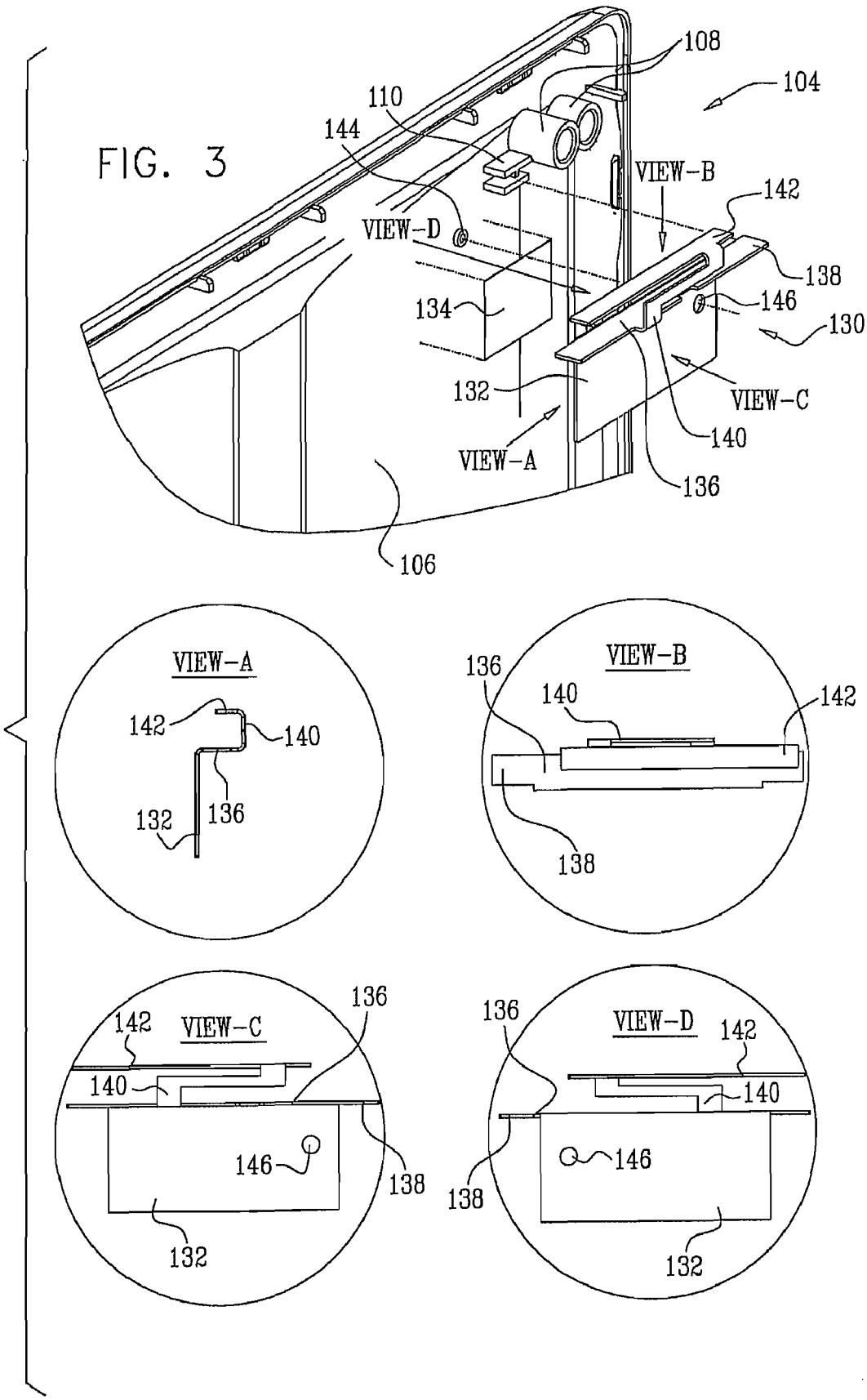
FIG. 3 is a simplified illustration of an antenna assembly prior to insertion into mounting engagement with the H-guide bracket of FIGS. 1-2B.
Figure 4A:
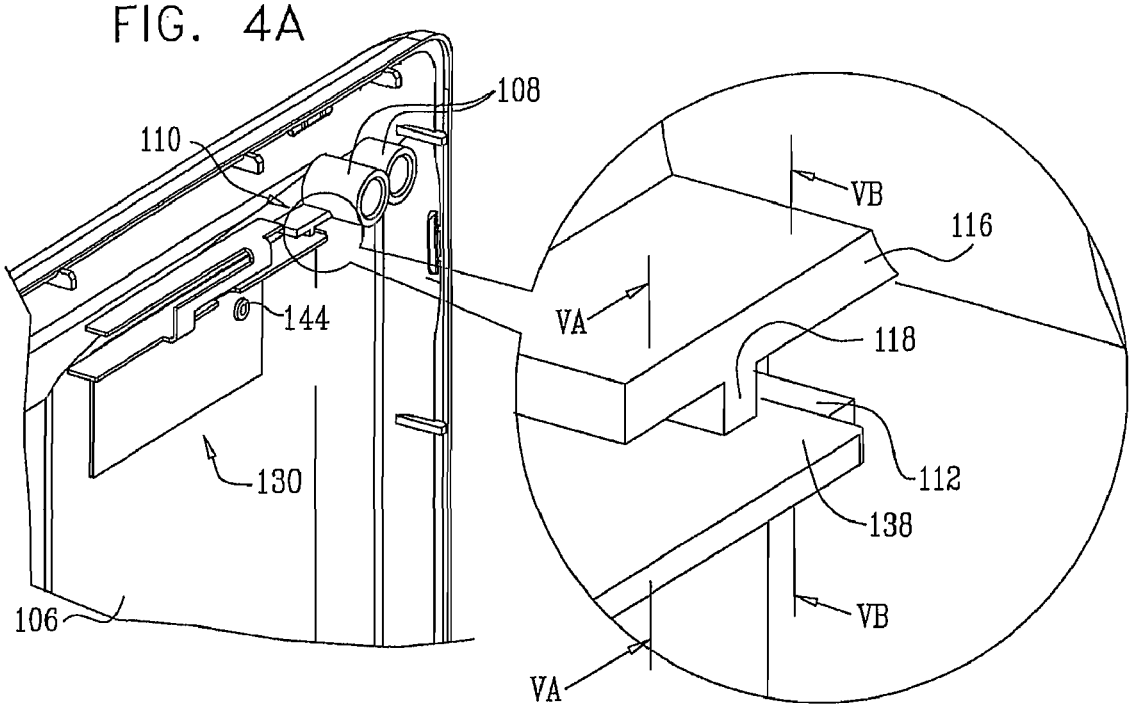
FIGS. 4A and 4B are simplified pictorial and plan view illustrations of the antenna assembly fixed to the H-guide bracket of FIGS. 1-2B.
Figure 4B:
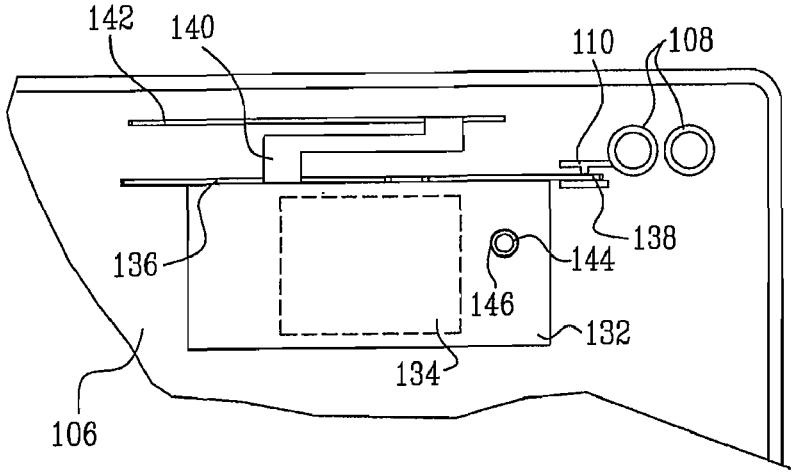
Figure 5A:
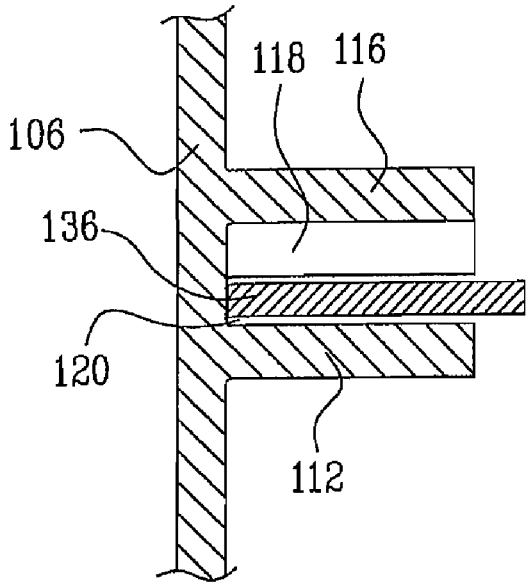
FIGS. 5A & 5B are sectional illustrations taken along lines VA-VA and VB-VB in FIG. 4A.
Figure 5B:
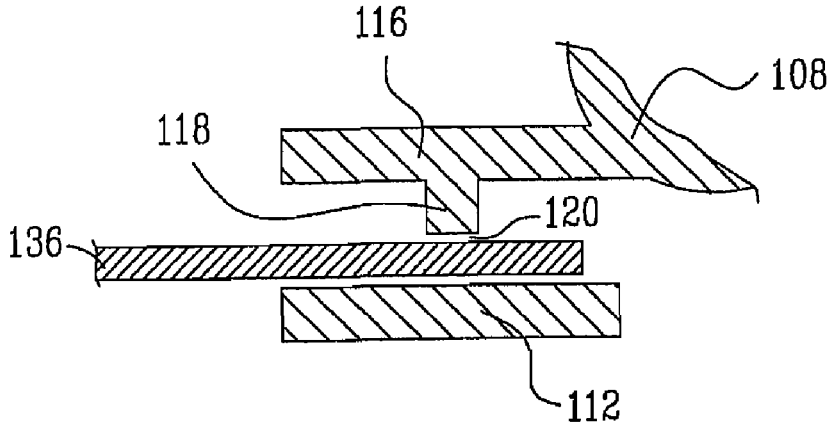

Reference is now made to FIG. 3, which is a simplified illustration of an antenna assembly prior to insertion into mounting engagement with the H-guide bracket of FIGS. 1-2B, to FIGS. 4A and 4B, which are simplified pictorial and plan view illustrations of the antenna assembly fixed to the H-guide bracket of FIGS. 1-2B, and to FIGS. 5A & 5B, which are sectional illustrations taken along lines VA-VA and VB-VB in FIG. 4A.

As seen in FIGS. 3-5B, an antenna element 130 is inserted into mounting engagement with the H-guide bracket 110. The antenna element 130 is preferably a unitary metal element, typically formed by bending a flat piece of metal, typically of thickness 0.4 mm, and includes a generally planar portion 132 which is arranged to lie in conductive touching engagement with a double-sided adhesive attachment element 134, which in turn is conductively and adhesively attached to surface 106 of housing portion 104.

Antenna element 130 also includes an upstanding edge 136, extending generally perpendicularly to planar portion 132 and including an end portion 138 which is configured to fit in gap 120, thereby to properly position the antenna element 130 with respect to housing portion 104. Antenna element 130 also includes a connection portion 140, which extends from edge portion 138 in a plane generally parallel to that of planar portion 132 to a dual band radiating portion 142, which lies in a plane generally perpendicular to that of planar portion 132.

A protrusion 144, extending outwardly from surface 106 of housing portion 104, preferably engages a corresponding hole 146 in planar portion 132 to further assist in proper positioning of the antenna element 130 with respect to the housing portion 104.

It will be appreciated by persons skilled in the art that the present invention is not limited by what has been particularly shown and described above. Rather the scope of the present invention includes both combinations and sub-combinations of features described and shown as well as modifications and variations thereof which would occur to a person skilled in the art upon reading the foregoing description and which are not in the prior art.

The invention claimed is:

1. A method of mounting an antenna assembly into computer apparatus comprising:

forming a mounting bracket on an interior surface of a housing of said computer apparatus, said mounting bracket comprising at least two upstanding surfaces defining a gap therebetween; and inserting a first portion of the antenna assembly into engagement with said mounting bracket and adhering a second portion of the antenna assembly to said interior surface.

2. A method of mounting an antenna assembly according to claim 1 and wherein said mounting bracket comprises first and second generally planar mutually spaced parallel upstanding portions and a third upstanding portion extending generally perpendicularly to said first and second generally planar portions from said first upstanding portion towards said second upstanding portion and defining a gap with respect to said second upstanding portion.

3. A method of mounting an antenna assembly according to claim 2 and wherein said second portion of said antenna assembly is adhered to said interior surface by means of a conductive adhesive and said interior surface defines a ground plane.

4. A method of mounting an antenna assembly according to claim 3 and wherein said second portion of said antenna assembly is positioned with respect to said interior surface by means of a protrusion formed on said interior surface which engages an aperture formed in said second portion of said antenna assembly.

5. A method of mounting an antenna assembly according to claim 2 and wherein said second portion of said antenna assembly is positioned with respect to said interior surface by means of a protrusion formed on said interior surface which engages an aperture formed in said second portion of said antenna assembly.

6. A method of mounting an antenna assembly according to claim 1 and wherein said second portion of said antenna assembly is adhered to said interior surface by means of a conductive adhesive and said interior surface defines a ground plane.

7. A method of mounting an antenna assembly according to claim 6 and wherein said second portion of said antenna assembly is positioned with respect to said interior surface by means of a protrusion formed on said interior surface which engages an aperture formed in said second portion of said antenna assembly.

8. A method of mounting an antenna assembly according to claim 1 and wherein said second portion of said antenna assembly is positioned with respect to said interior surface by means of a protrusion formed on said interior surface which engages an aperture formed in said second portion of said antenna assembly.

9. An arrangement for mounting an antenna assembly into computer apparatus comprising:

a mounting bracket formed on an interior surface of a housing of said computer apparatus, said mounting bracket comprising at least two upstanding surfaces defining a gap therebetween; and an antenna assembly including a first portion mounted into engagement with said mounting bracket and a second portion adhered to said interior surface.

10. An arrangement for mounting an antenna assembly according to claim 9 and wherein said mounting bracket comprises first and second generally planar mutually spaced parallel upstanding portions and a third upstanding portion extending generally perpendicularly to said first and second generally planar portions from said first upstanding portion towards said second upstanding portion and defining a gap with respect to said second upstanding portion.

11. An arrangement for mounting an antenna assembly according to claim 10 and wherein said second portion of said antenna assembly is adhered to said interior surface by means of a conductive adhesive and said interior surface defines a ground plane.

12. An arrangement for mounting an antenna assembly according to claim 11 and wherein said second portion of said antenna assembly is positioned with respect to said interior surface by means of a protrusion formed on said interior surface which engages an aperture formed in said second portion of said antenna assembly.

13. An arrangement for mounting an antenna assembly according to claim 10 and wherein said second portion of said antenna assembly is positioned with respect to said interior surface by means of a protrusion formed on said interior surface which engages an aperture formed in said second portion of said antenna assembly.

14. An arrangement for mounting an antenna assembly according to claim 9 and wherein said second portion of said antenna assembly is adhered to said interior surface by means of a conductive adhesive and said interior surface defines a ground plane.

15. An arrangement for mounting an antenna assembly according to claim 14 and wherein said second portion of said antenna assembly is positioned with respect to said interior surface by means of a protrusion formed on said interior surface which engages an aperture formed in said second portion of said antenna assembly.

16. An arrangement for mounting an antenna assembly according to claim 9 and wherein said second portion of said antenna assembly is positioned with respect to said interior surface by means of a protrusion formed on said interior surface which engages an aperture formed in said second portion of said antenna assembly.

17. A portable computer comprising:

computer processing, data input and display functionality enclosed in a housing; and an arrangement for mounting an antenna assembly into a portion of said housing, said arrangement comprising:

a mounting bracket formed on an interior surface of a housing of said computer apparatus, said mounting bracket comprising at least two upstanding surfaces defining a gap therebetween; and an antenna assembly including a first portion mounted into engagement with said mounting bracket and a second portion adhered to said interior surface.

18. A portable computer according to claim 17 and wherein said mounting bracket comprises first and second generally planar mutually spaced parallel upstanding portions and a third upstanding portion extending generally perpendicularly to said first and second generally planar portions from said first upstanding portion towards said second upstanding portion and defining a gap with respect to said second upstanding portion.

19. A portable computer according to claim 17 and wherein said second portion of said antenna assembly is adhered to said interior surface by means of a conductive adhesive and said interior surface defines a ground plane.

20. A portable computer according to claim 17 and wherein said second portion of said antenna assembly is positioned with respect to said interior surface by means of a protrusion formed on said interior surface which engages an aperture formed in said second portion of said antenna assembly.

* * * * *